US005317947A

United States Patent [19]

Miyata

[11] Patent Number: 5,317,947

[45] Date of Patent: Jun. 7, 1994

[54] MUSICAL TONE GENERATOR WITH A MULTIPLE PARAMETER WRITE OPERATION

[75] Inventor: Satoshi Miyata, Hamamatsu, Japan

[73] Assignee: Yamaha Corporation, Hamamatsu, Japan

[21] Appl. No.: 931,558

[22] Filed: Aug. 18, 1992

Related U.S. Application Data

[63] Continuation of Ser. No. 501,662, Mar. 29, 1990, abandoned.

[30] Foreign Application Priority Data

Mar. 29, 1989 [JP] Japan ..... 1-74978

[51] Int. Cl.[5] ..... G10H 1/18

[52] U.S. Cl. ..... 84/615; 84/622; 84/626

[58] Field of Search ..... 84/622-633, 84/477 R, 478, 615-620

[56] References Cited

U.S. PATENT DOCUMENTS 4,538,495 9/1985 Sato ..... 84/477 R
4,915,007 4/1990 Wachi et al. ..... 84/622
4,920,850 5/1990 Matsumoto et al. ..... 84/622
4,947,723 8/1990 Kawashima et al. ..... 84/627 X

FOREIGN PATENT DOCUMENTS 62-52317 11/1987 Japan .

*Primary Examiner*—Stanley J. Witkowski
*Attorney, Agent, or Firm*—Graham & James

[57] ABSTRACT

A musical tone generator according to the present invention can simultaneously write parameter data at a plurality of storage positions of a parameter storage apparatus for storing various parameters, which characterize a musical tone to be generated, by only one write command. According to the present invention, software can be simplified, and a write execution time can be shortened.

4 Claims, 4 Drawing Sheets

| TQ(CH TIME) | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| SELECTED INPUT | A | | D | | | | C | | | | B | | | | A | |
| ASS | AS 02 | AS 13 | AS 02 | AS 13 | AS 46 | AS 57 | AS 46 | AS 57 | AS 8A | AS 9B | AS 8A | AS 9B | AS CE | AS DF | AS CE | AS DF |

MUSICAL TONE GENERATOR WITH A MULTIPLE PARAMETER WRITE OPERATION

This is a continuation of copending application Ser. No. 07/501,662 filed on Mar. 29, 1990, now abandoned.

BACKGROUND OF THE INVENTION

1. Field of the Invention

The present invention relates to a musical tone generator applied to an electronic musical instrument, or the like and, more particularly, to a musical tone generator which can simultaneously write parameter data at a plurality of storage positions of a parameter storage apparatus for storing various parameters, which characterize a musical tone to be generated, by only one write command.

2. Prior Art

In a conventional electronic musical instrument, various values are written in a plurality of registers (parameter storage means) for storing parameters, and a musical tone is generated in accordance with these parameters. For example, in an FM sound source of an electronic musical instrument, parameter values must be written in predetermined registers to give an f number to a carrier operator and a modulator operator inside a musical tone forming means.

In this prior art, when a parameter value is written at one predetermined storage position of the parameter storage means, a write command must be independently executed.

On the other hand, when parameter values are written in the parameter storage means, the same parameter value is often written at a plurality of storage positions although different parameters may sometimes be written. For example, in a parameter write mode for giving the f number to the carrier operator and the modulator operator, since these operators are often operated by the same f number, the same f number value is written at two storage positions (different channel positions of a predetermined register) corresponding to the two operators. In this case, according to the prior art, even when the same parameter value is written, the write command must be executed twice to write the same data. As a result, software is complicated, and a long execution time is required accordingly.

SUMMARY OF THE INVENTION

The present invention has been made in consideration of the conventional problems, and has as its object to provide a musical tone generator used in an electronic musical instrument or the like, which can simplify software used for writing parameter values, and can shorten a write execution time.

In order to achieve the above object, according to the present invention, status data indicating whether or not simultaneous write access of parameter data is performed is stored at a plurality of storage positions of a parameter storage means, and when a simultaneous write instruction is issued, input parameter data is written at all the plurality of parameter storage positions of the parameter storage means corresponding to the status data.

In this manner, when a simultaneous write instruction is issued, only one write command need be executed to write the same parameter data at a plurality of predetermined parameter storage positions.

DETAILED DESCRIPTION OF THE PREFERRED EMBODIMENTS

An embodiment of the present invention will be described below with reference to the accompanying drawings.

Figure 1:
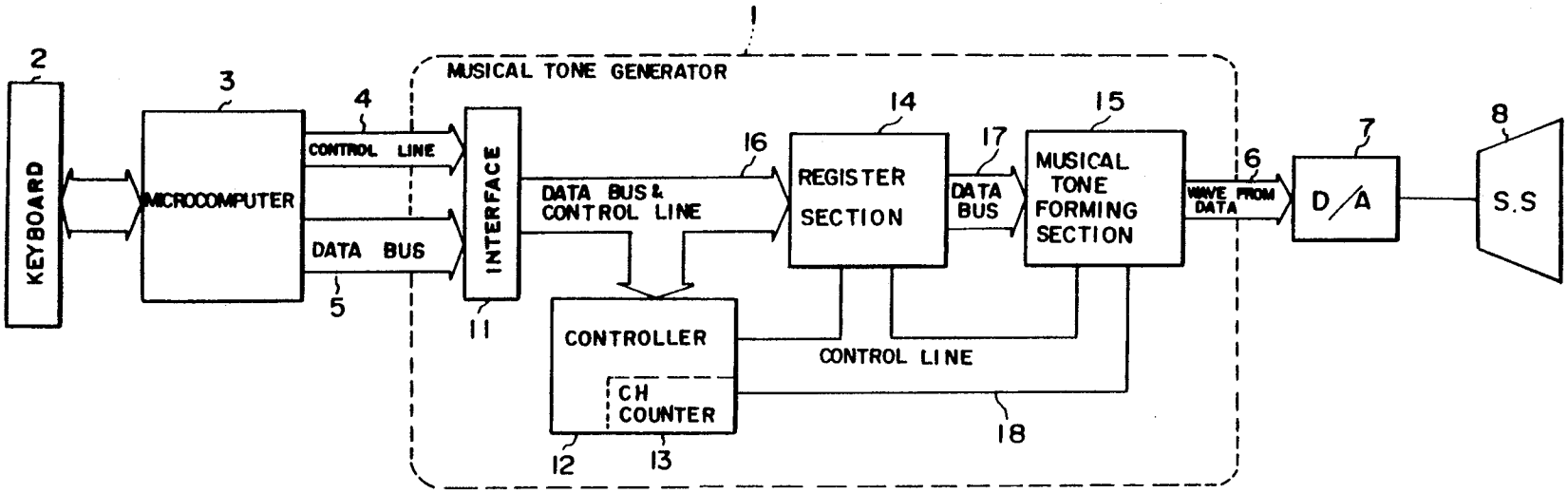
FIG. 1 is a block diagram of an electronic keyboard instrument to which a musical tone generator according to an embodiment of the present invention is applied.

FIG. 1 is a block diagram showing a schematic arrangement of an electronic keyboard instrument to which a musical tone generator according to an embodiment of the present invention is applied. Referring to FIG. 1, key ON data generated upon depression of a keyboard 2 is input to a microcomputer 3, and is subjected to predetermined processing. Thereafter, the processed data is input to an interface 11 of a musical tone generator 1 through a data bus 5. Reference numeral 4 denotes a control line for sending a control signal from the microcomputer 3. The musical tone generator 1 comprises the interface 11, a controller 12, a channel counter (to be referred to as a "CH counter" hereinafter) 13 arranged in the controller 12, a register section 14, and a musical tone forming section 15. Reference numeral 16 denotes a data bus & control line; 17, a data bus; and 18, a control line. Waveform data 6 output from the musical tone forming section 15 is produced as a tone by a sound system 8 through a digital-to-analog (D/A) converter 7.

Figure 3:
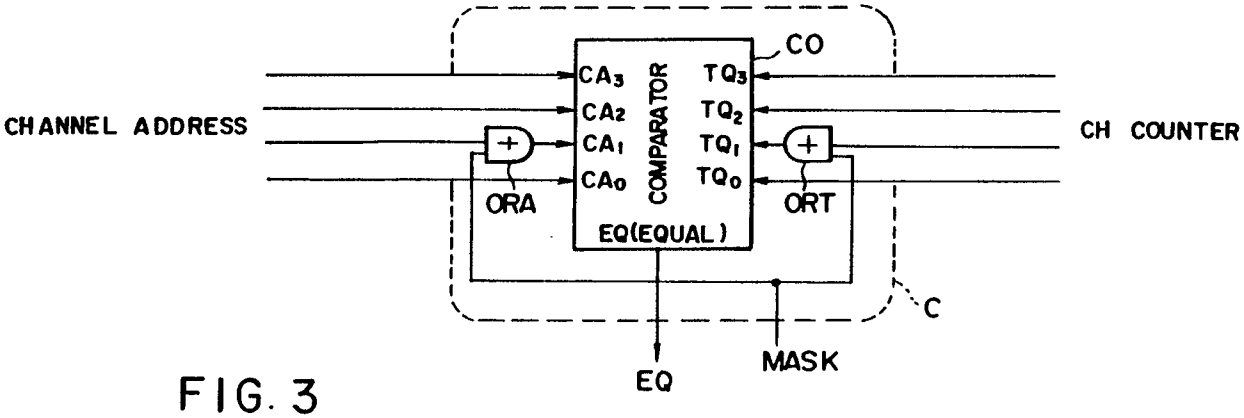
FIG. 3 is a detailed circuit diagram of a comparator.
Figure 2:
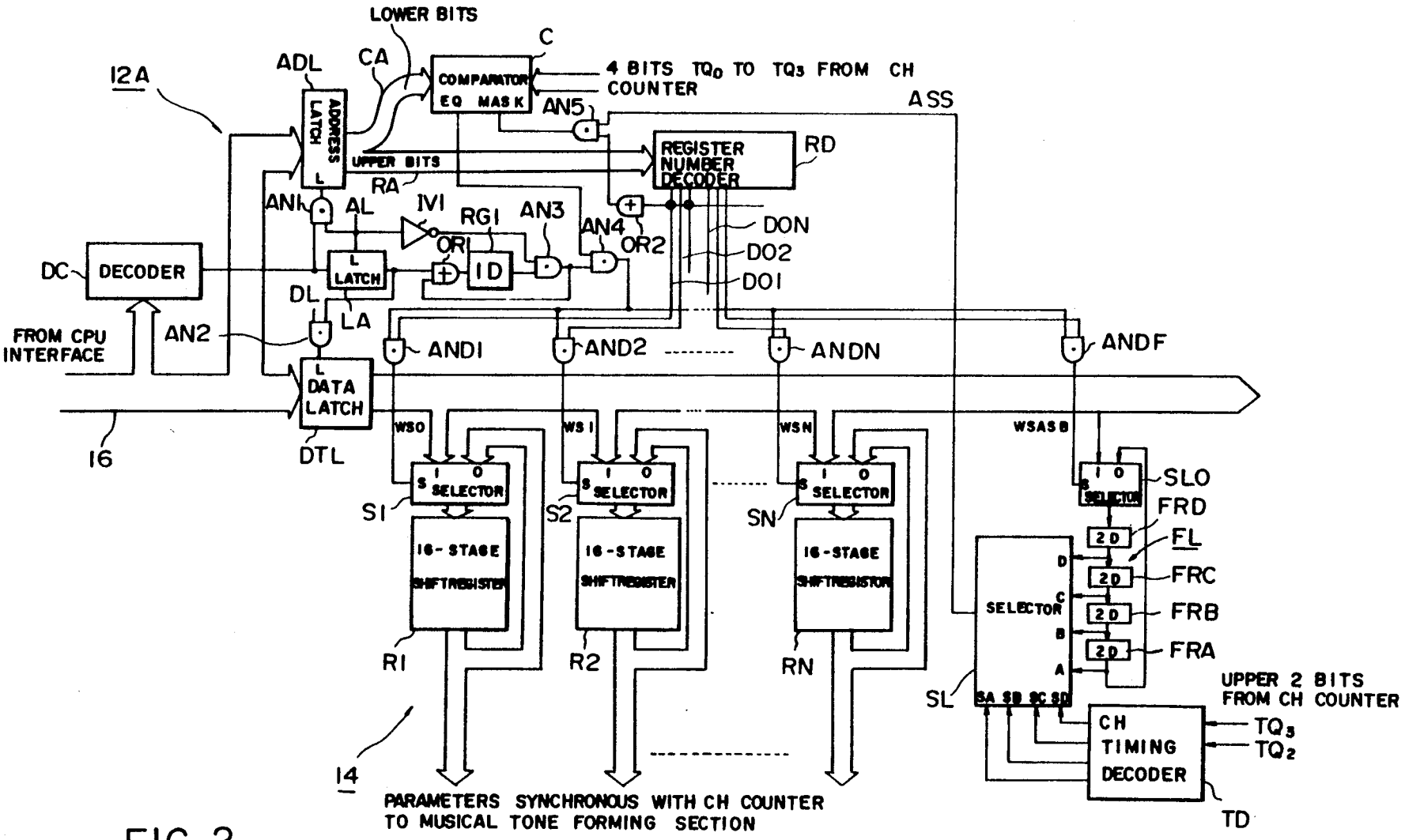
FIG. 2 is a circuit diagram showing a register and a portion of a controller of this embodiment.
Figure 4:
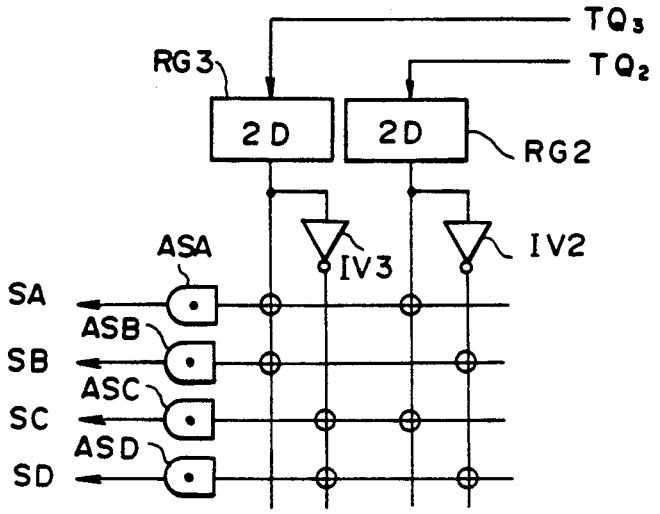
FIG. 4 is a detailed circuit diagram of a CH timing decoder.
Figure 5:
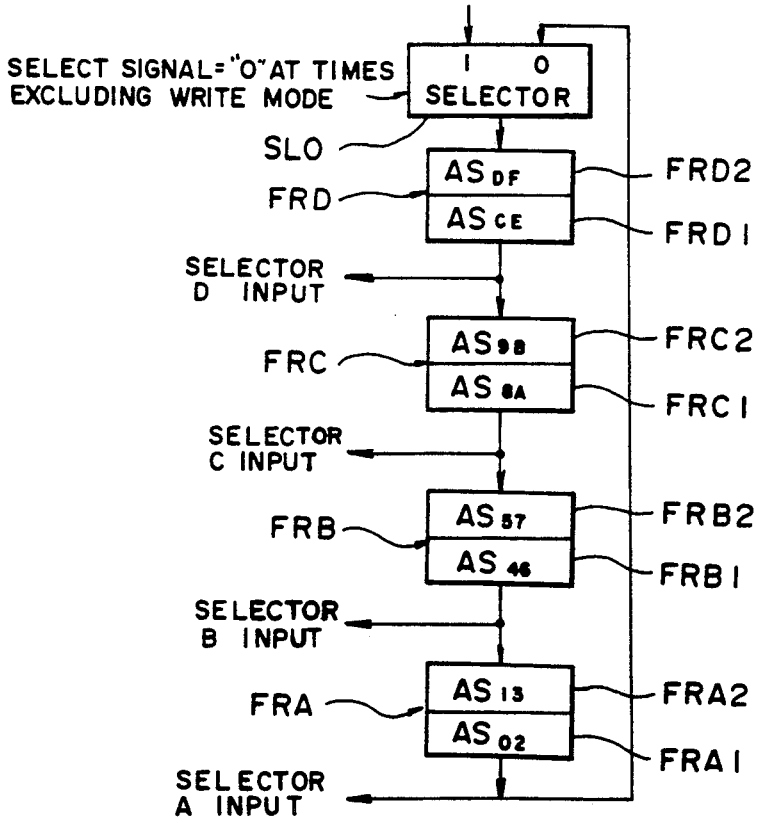
FIG. 5 is a detailed circuit diagram of a flag portion.

FIG. 2 is a detailed circuit diagram of the register section 14 and a portion 12A of the controller of the apparatus of this embodiment. FIG. 3 is a circuit diagram of a comparator C of the apparatus of this embodiment, FIG. 4 is a detailed circuit diagram of a CH timing decoder TD (FIG. 2), and FIG. 5 is a detailed circuit diagram of a flag FL portion (FIG. 2). The operation of the apparatus of this embodiment will be explained below with reference to these drawings.

A parameter storage means (registers) for storing parameter data will first be described below with reference to FIG. 2. In FIG. 2, reference symbols R1, R2, . . . , RN denote 16-stage shift registers for storing various parameter data. In this embodiment, a 16-tone simultaneous generating type musical tone generator is exemplified, and the 16-stage shift registers are employed in correspondence thereto. Parameter data stored in the registers R1 to RN are output to the musical tone forming section 15 in units of channel numbers. More specifically, a value (which is incremented like 0, 1, 2, . . . , 15 along with the lapse of time, and after 15, returns to 0) of a signal TQ (4 signal bits $TQ_0$ (LSB) to TQ3) output from the CH counter (not shown) is used as a channel number to output parameters. When the CH counter counts up, the shift registers R1 to RN are shifted by one stage, and parameters of the next channel are output. The output parameters are input to the musical tone forming section 15, and a musical tone is formed based on the output parameters.

A write operation of parameter data will be described below with reference to FIG. 2. In FIG. 2, reference symbols S1, S2, . . . , SN denote selectors which respectively correspond to the shift registers R1, R2, . . . , RN, and are used for writing parameter data in the corresponding shift registers. When signals WS0 to WSN input to terminals S of the selectors S1 to SN go to "1", the selectors S1 to SN output parameter data in a data latch DTL. The parameter data latched in advance by the data latch DTL is written in the shift registers R1 to RN.

In a parameter data write mode in the registers R1 to RN, a command and an address signal sent from a CPU interface are decoded by a decoder DC to discriminate if the input command is a write command of parameter data. The decoder DC detects only the write command, and determines the write command when a code consisting of a command and an address falls within a predetermined range. Upon detection of the write command, the decoder DC sets its output to be "1".

A CPU then sets an address latch signal AL to be "1". The address latch signal AL is input to a terminal L of a latch LA, and is also input to an AND gate AN1 and an inverter IV1. Therefore, since the output from the latch LA goes to "1" and a signal input to a terminal L of an address latch ADL goes to "1", address data on the bus line 16 is latched by the address latch ADL in response to the leading edge of the signal at the terminal L.

The CPU then converts data on the bus line 16 to parameter data to be written. The CPU then sets the address latch signal AL to be "0", and sets a data latch signal DL to be "1". The data latch signal DL is input to an AND gate AN2. Since the output from the latch LA is at "1" level, both the inputs of the AND gate AN2 go to "1". Therefore, the output from the AND gate AN2, i.e., a signal input to a terminal L of the data latch DTL goes to "1", and parameter data on the bus line 16 is latched by the data latch DTL in response to the leading edge of the signal at the terminal L.

Since the output from the latch LA is at "1" level, the output from a register RG1 is also at "1" level through an OR gate OR1. Since the signal AL is already set at "0", data "1" is input to an AND gate AN3 through the inverter IV1. Therefore, the output from the AND gate AN3 goes to "1". Note that this output is input to an AND gate AN4, and is also input to the OR gate OR1, thus holding an output "1" state of the AND gate AN3.

A number of a register in which data is to be written is assigned to the upper bits (or lower bits) of address data latched by the address latch ADL. This register number (register selection address) RA is input from the address latch ADL to a register number decoder RD, and is decoded thereby. As a result, one of outputs DO1 to DON corresponding to the predetermined register in which data is to be written goes to "1". Since the output from the AND gate AN3 is at "1" level, as described above, the output from the AND gate AN4 goes to "1" if an equal signal EQ from a comparator C is at "1" level. Therefore, a predetermined one of AND gates AND1 to ANDN which receive the outputs DO1 to DON of the register number decoder RD and the output from the AND gate AN4 sets the corresponding one of output signals WS0 to WSN to be "1".

A case wherein the equal signal EQ from the comparator C goes to "1" will be briefly described below. A channel number is assigned to lower bits (or upper bits) of address data latched by the address latch ADL. The channel number (tone generation channel selection address) CA is input from the address latch ADL to the comparator C, and is compared with the CH counter output (four bits $TQ_0$ to $TQ_3$). Note that comparison in the comparator C will be described in detail later with reference to FIG. 3. As a result of comparison by the comparator C, the comparator C outputs "1" to its terminal EQ at a timing of a channel for which parameter write access is to be executed.. Thus, the output from the AND gate AN4 goes to "1", as described above.

Figures 6, 7:
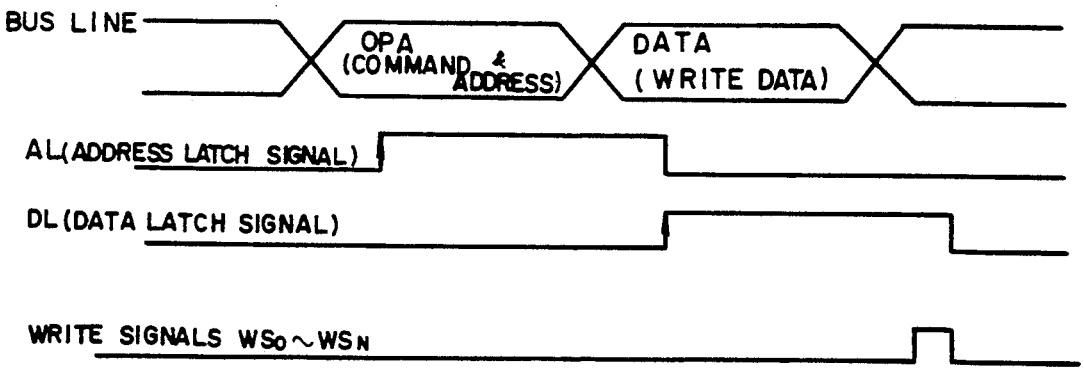
FIG. 6 is a table showing outputs from a selector SL.
FIG. 7 is a write timing chart.

In this manner, the predetermined one of the AND gates AND1 to ANDN corresponding to the registers R1 to RN outputs a "1"-level signal as one of the output signals WS0 to WSN. The "1" signal is input to the corresponding one of the terminals S of the selectors S1 to SN. Thus, parameter data latched by the data latch DTL is written in the corresponding one of the register R1 to RN. FIG. 7 shows the timing chart in a parameter data write mode.

The basic operation in the parameter data write mode has been described.

A simultaneous write operation as the characteristic feature of this embodiment will be described below.

The operation of the comparator C shown in FIG. 2 will be described in detail below with reference to FIG. 3. The comparator C includes a comparator CO, and OR gates ORA and ORT. The OR gate ORA receives the second lowest bit ($2^1$ bit) signal of the channel address CA, and a mask signal MASK, and its output is connected to a terminal $CA_1$ of the comparator CO. The OR gate ORT receives the second lowest bit ($2^1$ bit) signal of the counter value TQ from the CH counter and the mask signal MASK, and its output is connected to a terminal $TQ_1$ of the comparator CO. The comparator CO compares signals input to terminals $CA_0$ to $CA_3$ and signals input to terminals $TQ_0$ to $TQ_3$, and outputs the equal signal EQ when they coincide with each other.

With the above-mentioned arrangement of the comparator C, when the mask signal MASK is at "1" (output situation of the mask signal will be described later), the signals at the terminals $CA_1$ and $TQ_1$ of the comparator CO always coincide with each other. Therefore, in addition to a case wherein the channel address CA and the CH counter value TQ completely coincide with each other, the equal signal EQ is also output in combinations shown in Table 1 below when the mask signal MASK is "1".

TABLE 1

| CA Value (or TQ value) | TQ Value (or CA value) |
|---|---|
| 0 (= $0\underline{0}0)_2$) | 2 (= $0\underline{0}1)_2$ |
| 1 (= $0\underline{0}0)_2$) | 3 (= $0\underline{0}1)_2$ |
| 4 (= $0\underline{0}1)_2$) | 6 (= $0\underline{1}1)_2$ |
| 5 (= $0\underline{1}0)_2$) | 7 (= $0\underline{1}1)_2$ |
| 8 (= $0\underline{1}1)_2$) | A (= $0\underline{1}1)_2$ |
| 9 (= $1\underline{0}0)_2$) | B (= $1\underline{0}1)_2$ |
| C (= $1\underline{0}0)_2$) | E (= $1\underline{0}1)_2$ |
| D (= $1\underline{0}1)_2$) | F (= $1\underline{1}1)_2$ |

In Table 1 above, (. . . . . .)$_2$ expresses binary notation. In these combinations, bit values are equal to each other except for underlined $2^1$ bit values.

When the channel address CA is 0 (=$(0000)_2$) and the mask signal MASK is "1", the equal signal EQ="1" is output if the CH counter value TQ is 0 (=$(0000)_2$) and 2 (=$(0010)_2$) When the equal signal EQ goes to "1", parameter data in the data latch DTL is written in a predetermined register. In this case, the same parameter data is written at storage positions of registers corresponding to two channels. In a conventional apparatus, write access is performed in response to a single write command when the channel address and the CH counter value completely coincide with each other while the CH counter TQ is incremented from 0 to 15. In this embodiment, write access can also be almost simultaneously performed for the corresponding channels in Table 1.

The way of sending the mask signal MASK indicating whether or not simultaneous write access of the same data to a plurality of channels is to be performed will be described below.

In FIG. 2, reference symbol FL denotes a flag indicating whether or not simultaneous write access is to be performed for a plurality of channels (i.e., a simultaneous write instruction means for storing a state indicating whether or not simultaneous write access is to be performed). The flag FL is constituted by four shift registers FRA, FRB, FRC, and FRD. FIG. 5 shows the flag FL in detail. The shift registers FRA to FRD comprise 2-bit shift registers, and are shifted according to the CH counter value TQ. FIG. 5 shows the content of the flag FL at a timing when the CH counter value TQ is 0 ($TQ_0$ to $TQ_3$ are all "0"s). $AS_{02}$ indicates a flag for connecting channels 0 and 2. When the flag $AS_{02}$ is "1", data is simultaneously written in the channels 0 and 2. When this flag is "0", no simultaneous write access is executed. Similarly, $AS_{13}$, $AS_{46}$, and the like are also flags for connecting channels indicated by suffices. When the CH counter value TQ is changed from 0 to 1, these values are shifted by one, and are stored as shown in Table 2 below.

TABLE 2

| Flag Storage Position | Stored Value |
|---|---|
| FRD2 | $AS_{02}$ |
| FRD1 | $AS_{DF}$ |
| FRC2 | $AS_{CE}$ |
| FRC1 | $AS_{9B}$ |
| FRB2 | $AS_{8A}$ |
| FRB1 | $AS_{57}$ |
| FRA2 | $AS_{46}$ |
| FRA1 | $AS_{13}$ |

When the CH counter is further incremented, the stored values are shifted downward in FIG. 5, and the value stored at the lowermost storage position FRA1 is stored at the uppermost storage position FRD2.

FIG. 4 is a detailed circuit diagram of a CH timing decoder TD shown in FIG. 2. The CH timing decoder TD is operated based on upper 2 bits $TQ_3$ and $TQ_2$ of the CH counter. Reference symbols RG2 and RG3 denote shift registers for delaying inputs $TQ_2$ and $TQ_3$ by two clocks; and IV2 and IV3, inverters. Reference symbols ASA to ASD denote AND gates for calculating logical products of inputs indicated by marks "o". The outputs from these AND gates ASA to ASD are input to a selector SL shown in FIG. 2.

FIG. 6 is a table showing which of values $AS_{02}$, $AS_{13}$, . . . , stored in the flag FL is to be output as an output signal ASS of the selector SL shown in FIG. 2. Since the shift registers RG2 and RG3 are arranged, select signals SA to SD are output in correspondence with the CH counter value TQ, as shown in the table of FIG. 6. More specifically, when the TQ value is 0, 1, E, and F, the select signal SA is output; when it is 2 to 5, the select signal SD is output; when it is 6 to 9, the select signal SC is output; and when it is A to D, the select signal SB is output.

Since the flag FL is shifted according to the CH counter value TQ, the output signal ASS is changed as shown in FIG. 6. More specifically, when TQ=0, the CH timing decoder outputs the select signal SA, as described above. In this case, an input to a terminal A of the selector SL is the value $AS_{02}$ stored in the flag FRA1 in FIG. 5, and the selector SL outputs the value $AS_{02}$ as the signal ASS.

When TQ=1, the CH timing decoder outputs the select signal SA. In this case, an input to the terminal A of the selector SL becomes the value $AS_{13}$ stored in the flag FRA1 in a state shifted by one from the state shown in FIG. 5, and the selector SL outputs the value $AS_{13}$ as the signal ASS.

When TQ=2, the CH timing decoder outputs the select signal SD. In this case, an input to a terminal D of the selector SL becomes the value $AS_{02}$ stored in the flag FRD1 in a state shifted by two from the state shown in FIG. 5, and the selector SL outputs the value $AS_{02}$ as the signal ASS.

The selector SL is similarly operated, and the signal ASS is output to have a correspondence shown in FIG. 6.

The signal ASS output from the selector SL is input to an AND gate AN5 shown in FIG. 2. The other input terminal of the AND gate AN5 receives a logical sum of signals corresponding to registers to be subjected to multichannel simultaneous write access of the outputs from the register number decoder RD (i.e., register selection signals) calculated by an OR gate OR2 (in this embodiment, simultaneous write access is executed for the first and third channels, and the like, but parameters which can be subjected to simultaneous write access are not limited to these channels). Therefore, when a register which is designated by a parameter write command is one which is to be subjected to simultaneous write access, the data $AS_{02}$, $AS_{13}$, $AS_{46}$, . . . are input to the mask terminal MASK of the comparator C at the corresponding timings of TQ. For example, when TQ=0, the mask signal MASK becomes the value $AS_{02}$, and if the value $AS_{02}$ is "1", the equal signal EQ is output (upon operation of the comparator C) even if the channel selection address CA designates the second channel. Thus, parameter data is written in the 0th channel of the corresponding register. A similar operation is performed, and the same parameter data is written in a plurality of channels.

Note that write access of the flag FL can be performed in the same manner as in write access of the shift registers R1 to RN. In this embodiment, the same parameter value is written in two channels of one register. An application wherein the same value is written in three or more channels can be similarly realized.

As described above, according to the present invention, parameter data can be simultaneously written at two or more parameter storage positions of a parameter storage means by one write command. Therefore, software can be simplified, and a write execution time can be shortened.

What is claimed is:

1. A musical tone generator having a parameter transmitting function comprising:

a plurality of channel registers each capable of storing a parameter which characterizes a musical tone to be generated;

musical tone generating means for generating musical tones based on said parameters having a plurality of tone generation channels, each of which generates said musical tones characterized by the parameter stored in a corresponding one of the channel registers;

commanding means for outputting a writing command; and writing means for writing the same parameter into two or more of said channel registers in response to said writing command, whereby the same parameter is written into a plurality of channel registers in response to a single writing command.

2. A musical tone generator according to claim 1 wherein the writing means can selectively write a parameter into a single channel register, the tone generator further comprising a designating means for designating a single write state or a plural write state, wherein said writing means writes said parameter into a single one of said channel registers in response to said writing command when said designating means designates said single write state, said writing means writes the same parameter into two or more of said channel registers in response to said writing command when said designating means designates said plural write state.

3. A musical tone generator according to claim 1 further comprising designating means for designating said two or more channel registers into which the same parameter is written.

4. A musical tone generator according to claim 1 wherein said plurality of storage portions are channel registers which store parameters for tone generation channels respectively, each of which generates a musical tone characterized by the corresponding parameter.

* * * * *